US005996977A

United States Patent [19]

Burgess

[11] Patent Number: 5,996,977

[45] Date of Patent: Dec. 7, 1999

[54] TEMPERATURE ADJUSTED WATER AERATOR AND CIRCULATION SYSTEM

[76] Inventor: Harry L. Burgess, 5400 Memorial, #511, Houston, Tex. 77007

[21] Appl. No.: 09/166,439

[22] Filed: Oct. 5, 1998

Related U.S. Application Data

[63] Continuation-in-part of application No. 09/112,480, Jul. 9, 1998.

[51] Int. Cl.[6] ..... B01F 3/04

[52] U.S. Cl. ..... 261/140.1; 261/93; 261/121.1; 261/121.2

[58] Field of Search ..... 261/93, 120, 121.1, 261/121.2, 131, 136, 140.1, 140.2, 141, 142, 124; 210/220, 242.2

[56] References Cited

U.S. PATENT DOCUMENTS

| | | | |
|---|---|---|---|
| 2,510,427 | 6/1950 | Souchie | 261/142 |
| 3,017,951 | 1/1962 | Wiley | 183/2.5 |
| 3,189,334 | 6/1965 | Bell | 261/93 |
| 3,214,149 | 10/1965 | Budzien | 261/29 |
| 3,279,768 | 10/1966 | Niewiarowicz | 261/29 |
| 3,320,928 | 5/1967 | Smith | 261/121.1 |
| 3,347,371 | 10/1967 | Verbaere | 209/172 |
| 3,371,789 | 3/1968 | Hense | 210/169 |
| 3,635,342 | 1/1972 | Mourlon et al. | 210/84 |
| 3,756,578 | 9/1973 | McGurk | 261/91 |
| 3,800,462 | 4/1974 | Coyle | 43/57 |
| 3,815,277 | 6/1974 | Murray | 43/57 |
| 3,837,627 | 9/1974 | Sence et al. | 261/29 |
| 3,846,516 | 11/1974 | Carlson | 261/87 |
| 3,920,779 | 11/1975 | Abele | 261/87 |
| 3,940,461 | 2/1976 | Martin et al. | 261/91 |

(List continued on next page.)

FOREIGN PATENT DOCUMENTS

| | | | |
|---|---|---|---|
| 2558898 | 7/1977 | Germany | 261/93 |
| 2618838 | 11/1977 | Germany | 261/93 |
| 28 23 515 | 12/1979 | Germany . | |
| 3208025 A1 | 9/1983 | Germany . | |
| 688308 | 3/1953 | United Kingdom . | |

OTHER PUBLICATIONS

Mino–Mizer Live Bait Aerator brochure, 1 page, 1988.

WaterBuster Cordless Pump 4140 Operating Instructions, 1 page.

Atwood Mini King 350 and 500 Bilge Pumps 4100 and 4105 Installation Instructions, 2 pages.

*Primary Examiner*—Richard L. Chiesa
*Assistant Examiner*—Robert A. Hopkins
*Attorney, Agent, or Firm*—Thomason, Moser & Patterson

[57] ABSTRACT

The present invention provides for an aquatic environment an aerator having a temperature adjusted air inlet for aerating a quantity of water in a container, where the temperature of air pumped through an aerator may be cooled or heated, the temperature adjusted air entrained with water, and exhausted through an outlet into a bait well or a larger container, such as a pond for raising aquatic livestock. The temperature adjusted air may be supplied from an air conditioning unit in an automobile, a portable or fixed refrigeration unit, or gas flowing through an chilled environment of cooled liquid. In another embodiment, the temperature adjusted air may be drawn through an underground or underwater thermal stabilized conduit, using the natural temperature stability of underlying formations or layers. In another embodiment, where warm air is preferred, alternative sources of temperature adjusted air may be used, as for instance, an automobile heater, heaters using combustible fuels or electrical resistance heating, and even the underground or underwater thermal stabilization conduit that is also used for cooling during summer months. In some embodiments, the aerator may float, may be positioned at some relatively fixed point in the container, such as on the bottom, or may be a variable buoyancy aerator that varies the level at which the aerator is situated in the container. In another embodiment, multiple aerators are controlled in a larger container for aerating and mixing the container, where the aerators draw temperature adjusted air from a manifold.

33 Claims, 13 Drawing Sheets

U.S. PATENT DOCUMENTS

| | | | |
|---|---|---|---|
| 4,003,796 | 1/1977 | Müller et al. | 195/142 |
| 4,029,724 | 6/1977 | Müller et al. | 261/87 |
| 4,051,204 | 9/1977 | Müller et al. | 261/36 |
| 4,086,306 | 4/1978 | Yoshinaga | 261/93 |
| 4,096,215 | 6/1978 | Albrecht | 261/121 |
| 4,140,737 | 2/1979 | Hauser | 261/93 |
| 4,142,972 | 3/1979 | Nebeker et al. | 210/84 |
| 4,235,720 | 11/1980 | Nakajima et al. | 210/242.2 |
| 4,240,990 | 12/1980 | Inhofer et al. | 261/87 |
| 4,255,360 | 3/1981 | Jeffries | 261/5 |
| 4,280,911 | 7/1981 | Durda e tal. | 210/629 |
| 4,290,885 | 9/1981 | Kwak | 210/197 |
| 4,297,214 | 10/1981 | Guarnaschelli | 210/219 |
| 4,328,175 | 5/1982 | Roecket et al. | 261/91 |
| 4,348,288 | 9/1982 | Yoshinaga et al. | 210/708 |
| 4,382,804 | 5/1983 | Mellor | 95/270 |
| 4,409,100 | 10/1983 | Rajendren | 210/219 |
| 4,437,765 | 3/1984 | Seeger | 366/264 |
| 4,448,685 | 5/1984 | Malina | 210/219 |
| 4,454,077 | 6/1984 | Litz | 261/91 |
| 4,465,645 | 8/1984 | Kaelin | 261/87 |
| 4,597,863 | 7/1986 | Rymal, Jr. | 210/117 |
| 4,620,925 | 11/1986 | Allen | 210/219 |
| 4,687,585 | 8/1987 | Ramshaw | 210/787 |
| 4,732,682 | 3/1988 | Rymal | 210/620 |
| 4,829,698 | 5/1989 | McDonald | 43/57 |
| 4,851,133 | 7/1989 | Rymal | 210/776 |
| 4,853,124 | 8/1989 | Terada | 210/242.2 |
| 4,917,577 | 4/1990 | Stirling | 417/66 |
| 4,994,177 | 2/1991 | Bogar, Jr. | 210/167 |
| 5,009,816 | 4/1991 | Weise et al. | 261/21 |
| 5,021,165 | 6/1991 | Kalins | 210/703 |
| 5,139,659 | 8/1992 | Scott | 210/169 |
| 5,172,511 | 12/1992 | Smith et al. | 261/121.2 |
| 5,213,718 | 5/1993 | Burgess | 261/93 |
| 5,275,762 | 1/1994 | Burgess | 261/4 |

TEMPERATURE ADJUSTED WATER AERATOR AND CIRCULATION SYSTEM

This application is a continuation-in-part of U.S. Ser. No. 09/112,480, filed Jul. 9, 1998 pending, and claims priority thereto.

FIELD OF THE INVENTION

The present invention relates to systems and methods for containing and maintaining aquatic life. More particularly, the invention relates to systems and methods for aerating and cooling water in a container for aquatic life.

BACKGROUND OF THE RELATED ART

It is often necessary or desirable to transport or maintain a small quantity of aquatic life in a small container. For example, the use of live bait, such as minnows or shrimp, for fishing requires that a container be used to transport a sufficient amount of bait for a day long fishing trip. It is preferred that the container provide sufficient aeration and fresh water for the bait during this period. Another example is the collection of live marine animals, such as crabs or shrimp, for personal consumption or resale to distributors or restaurants. It is most desirable to transport and maintain shrimp or other marine life in a container that provides sufficient oxygen and fresh water for the marine life to stay alive and well until just before consumption.

Typically, a container is filled with water and aerated with a device such as a bubble tube. When using a small fishing or shrimping boat, the container may take the form of a common cooler or refrigeration box, comprising a plastic shell with a hinged lid. These coolers vary in size, but typically a water-filled cooler may be moved by one or two individuals from a boat to the dock and into an automobile. Furthermore, in commercial shrimping or fishing operations, the container for storing marine life may be significantly larger and perhaps comprise a portion of the vessel's hull. Certainly, the capacity of the oxygenating device will vary in proportion to the size of the container and the population of marine life to be maintained. If the population of marine life maintained in the container is high relative to the size of the container and the amount of water contained therein, then it is necessary to periodically replace the water with fresh water due to the increase in the concentration of waste products. The operation of removing and replacing the water may be accomplished through a number of methods. With small containers or coolers, this operation may include manually bailing water with a bucket or tipping the container over the side of the boat. Both of these methods, and other similar methods, are inefficient and require hard work. Furthermore, these methods involve a risk that some or all of the marine life will be swept from the container along with the water or otherwise lost during the operation.

For larger aqua-culture environments, such as ponds, tanks or other aquatic containment systems used for raising and maintaining fish or other aquatic livestock, aeration is also needed to supply sufficient oxygen to the aquatic livestock or the livestock may die. In addition to the aeration apparatus, the aquatic environment needs agitation of the bottom surface to prevent stagnation of the bottom portion of the aquatic environment. Stagnation at the bottom of the aquatic environment leads to undesirable growth of bacteria and/or fungus in the aquatic environment which is detrimental to the health of the aquatic livestock. Agitation of the bottom of the aquatic environment also stirs up and redistributes the nutrients or food that have sunk to the bottom of the aquatic environment.

Various aerators have been used to provide oxygenation to various aquatic environments. For example, U.S. Pat. No. 's 5,275,762 and 5,213,718, hereby incorporated by reference, disclose a floating aerator that is useful for aerating a top portion of an aquatic environment. These patents also disclose an alternative embodiment that is fixedly attached to a bottom of the aquatic environment to provide aeration to the bottom portion of the aquatic environment. However, typical aerators are not capable of providing aeration at various vertical positions within the aquatic environment, as well as agitation to the bottom of the aquatic environment. Furthermore, these aerators do not provide a scheme for controlling circulation within the aquatic environment.

In addition to the above aeration and replenishment needs, typical aerators use air having an ambient temperature. In most instances, aquatic life fares better at certain temperatures native to their environment. Thus, even aerated water at a less than an optimum temperature may adversely influence the lifespan, health, reproduction, and growth of aquatic life. Furthermore, since most sport fishing, using live bait, is done during the time of year when the ambient temperature is higher than the desired water temperature, by using air with an ambient temperature to aerate a container of bait, the water temperature may actually rise and accelerate the problems for aquatic health.

Therefore, there remains a need for an apparatus that aerates the aquatic environment with non-ambient temperature air. It would be desirable for the apparatus to aerate the aquatic environment at various vertical positions. There is also a need for a method for maintaining oxygenation, providing bottom agitation and controlling circulation to an environment for aquatic livestock.

SUMMARY OF THE INVENTION

The present invention provides an aerator having a temperature adjusted gas inlet for aerating a quantity of liquid in a container, whether in a portable container or a more fixed container. Specifically, the temperature of air pumped through an aerator may be cooled or heated, the temperature adjusted air entrained with water, and exhausted through an outlet into a bait well or a larger container, such as a pond for raising aquatic livestock, to assist in providing a more habitable aquatic environment. The temperature adjusted air may be supplied, for instance, from an air conditioning unit in an automobile, a portable or fixed refrigeration unit, or gas flowing through an chilled environment of cooled liquid. In another embodiment, the temperature adjusted air may be drawn through an underground or underwater thermal stabilized conduit, using the natural temperature stability of underlying formations or layers. In another embodiment, where warm air is preferred, for instance during the winter months, alternative sources of temperature adjusted air may be used, as for instance, an automobile heater, heaters using combustible fuels or electrical resistance heating, and even the underground or underwater thermal stabilization conduit that is also used for cooling during summer months.

The present invention may include a system for maintaining an aqua-culture environment, comprising an aerator having an outlet and a gas inlet, a temperature adjusted source of non-ambient temperature gas, a conduit fluidicly connected to the gas inlet of the aerator on one portion of the conduit and to the temperature adjusted source on another portion of the conduit, and a power source to operate the aerator. The present invention may include a system for maintaining an aqua-culture environment, comprising an aerator having an outlet, and a gas inlet fluidicly connected to the aerator and adapted to receive a gas having a non-ambient temperature and to pump the non-ambient temperature gas through the aerator. Furthermore, the present invention may include a system for maintaining an aqua-culture environment, comprising an aerator having an outlet, a liquid inlet, and an upwardly extending gas inlet adapted to allow gas to enter the pump in conjunction with liquid and to cause mixing of the gas and liquid prior to leaving the outlet, an evacuable float adapted to allow the system to vary the buoyancy of the aerator, a conduit fluidicly connected to the aerator and adapted to receive a gas having a non-ambient temperature, and a power source adapted to operate the aerator. A method for maintaining an aqua-culture environment in accordance with the present invention may include providing an aerator for an aqua-culture environment, and pumping a non-ambient temperature gas through the aerator into the aqua-culture environment. Additionally, the present invention provides for a temperature adjusted aerator that may vary its vertical position in the water through a variable buoyancy aerator, as well as agitate the bottom of an aquatic environment.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides a system for maintaining aquatic life, such as fish, shrimp, other marine animals, microbial populations, plant life and combinations thereof. The present invention relates to an improved aerator having a temperature adjusted gas, such as air, pumped into a container in which aquatic life exist, thereby altering the temperature of the liquid in the container compared to pumping ambient temperature gas. In the preferred embodiment, the aerator may be a centrifugal pump having a centrifugal impeller with an air inlet upwardly mounted and a water inlet, wherein the water inlet is sized, such as through an annulus, to restrict the flow of water to less than the pump is capable of pumping and thus draw air from a cooled source through the air inlet, mix the air and water to aerate the mixture, and then pump the entrained cooled air into the container, thereby aerating the container. In one aspect of the invention, the pump is a centrifugal pump adapted for at least two operating modes. In an aerating mode, the pump casing maintains a disposition with the liquid inlet opening generally upward from a horizontal plane and capable of taking in liquid from a body of liquid in which the pump is disposed and also take a substantial amount of air or other gas from an area above that body of liquid to the pump's impeller region. Preferably, the pump thus takes in so much air that it surges, or is on the verge of surging, typically known as "cavitating". A pump which is adapted to operate in an aerating mode is described in the '762 and '718 patents, noted above. In a water pumping mode, the liquid inlet to the pump is flooded or otherwise provided with sufficient water, so that the supply of air to the pump inlet is substantially cut off Therefore, the pump draws water through it's inlet and discharges the water under pressure through an outlet opening.

The term "aerator", as used herein, is used to describe any device useful for aerating a fluid, where "aerating" means introducing air or any other gas into a liquid, such as water. Since a typical application of aerators is the introduction of air into water in a live bait container, this description will refer to air and water for convenience, without limiting the scope of the invention.

Figure 1:
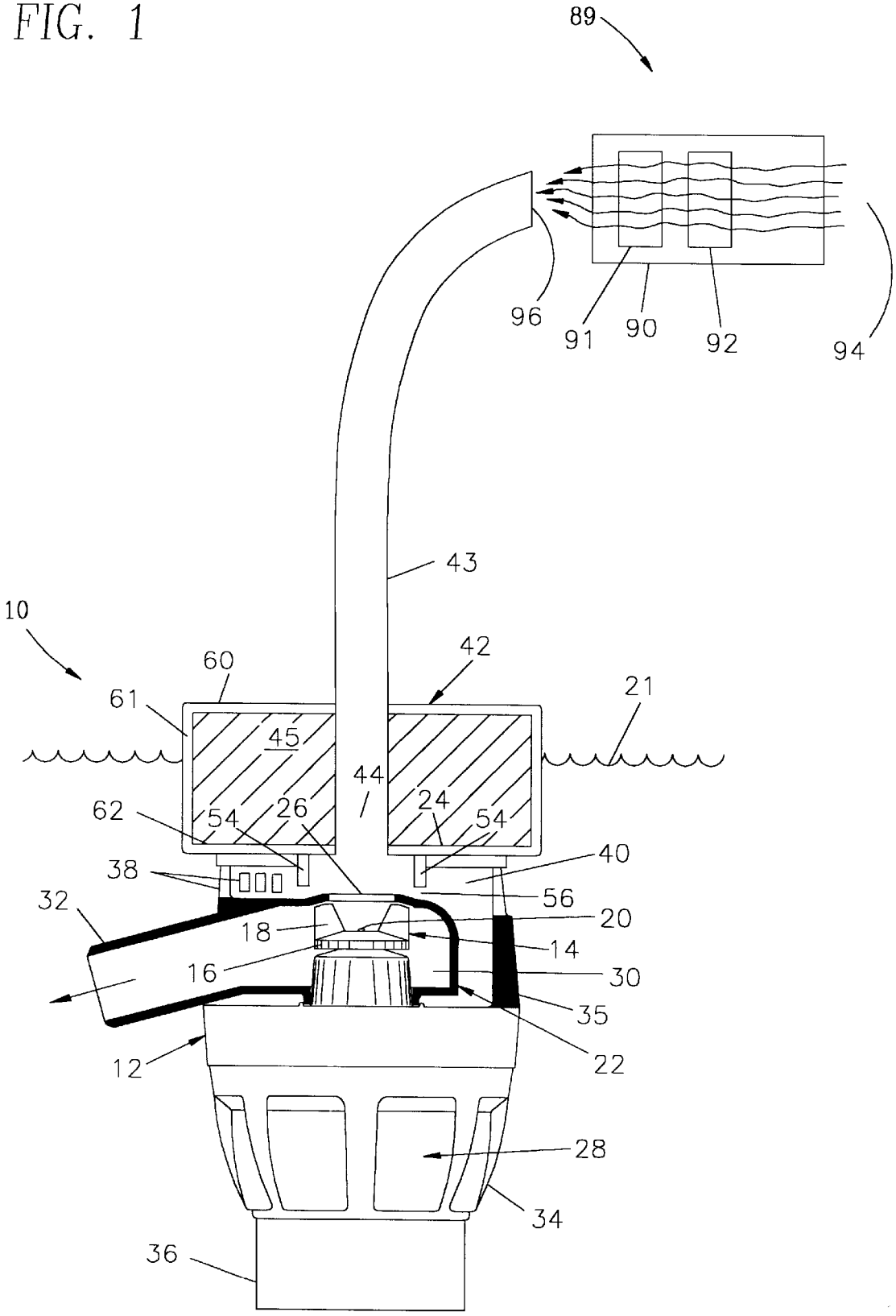
FIG. 1 is a cross-sectional view of a pump according to the present invention in an aerating mode.
Figure 2:
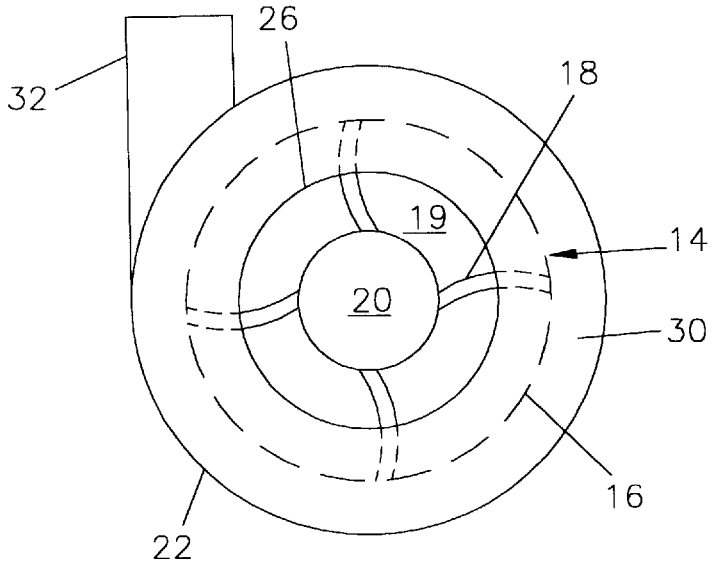
FIG. 2 is a top view of an impeller disposed within an impeller housing.

FIG. 1 is a cross sectional view of one embodiment of an aerator, according to the invention. The aerator 10 generally comprises a pump 12, which may be centrifugal or vane or other suitable types, and a float 42 disposed above the pump 12. The pump 12 generally comprises a pump inlet 26, an impeller 14 disposed below the pump inlet 26, one or more pump outlets 32 extending outwardly from the impeller 14 and a motor 28 connected to rotate the impeller 14. Extending "outwardly" includes radially, for example, which for the purposes of the present invention would also include tangentially directed outlets. FIG. 2 is a top view of an impeller 14 disposed within an impeller housing 22. The pump 12 includes a hubbed, vaned, rotary impeller 14 connected to and driven by a motor 28. The impeller 14 includes a disk-like bottom plate 16 and a plurality of blades 18 rigidly mounted on the upper surface of the plate 16. The blades 18 extend generally radially from an eye 20 defined in a central portion of the bottom plate 16. A plurality of flow passages 19 are defined between the blades 18. As shown in FIG. 2, the blades 18 curve radially and tangentially in a well-known manner for impeller designs.

Figure 3:
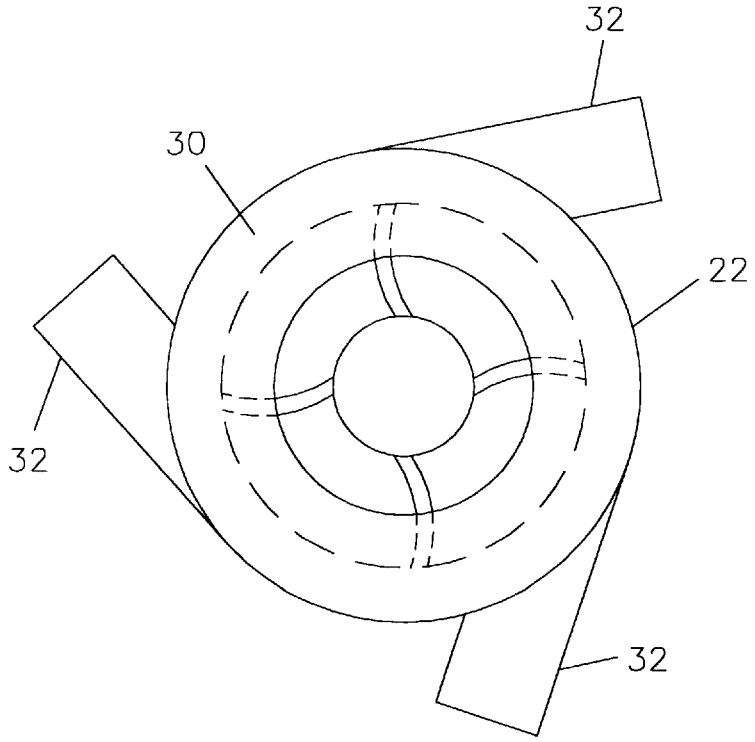
FIG. 3 is a top view of an alternate embodiment of the invention, showing a plurality of pump outlets.

The impeller 14 is generally positioned in a central portion of an impeller housing 22. A generally annular outer region 30 is defined between the impeller 14 and a side wall of the impeller housing 22. As shown in FIGS. 1 and 2, a pump outlet 32 extends radially outward from the annular outer region 30. Alternatively, as shown in FIG. 3, a plurality of pump outlets 32 extend outwardly from the annular outer region 30 in a plurality of radial directions. The impeller housing 22 has a top wall 24, shown in FIG. 1, that closely overlies a majority of the radially outermost portion of the blades 18, i.e., at least half of the blade length. The top wall 24 of the impeller housing 22 has a central, axially upwardly opening pump inlet 26 that overlies and exposes the eye 20 of the impeller 14 and the radially innermost portion of the blades 18. Thus, the pump 12 floats in the tank substantially below the water level 21 in the tank and in an inverted position from the manner in which such a pump is normally mounted. That is to say, the motor 28, described below, is mounted so that a drive shaft and the impeller 14 extend above the motor 28, rather than extending below the motor as is usually the case, and the inlet 26 opens upwardly as shown.

In FIG. 1, water enters the pump 12 through the pump inlet 26 in an axial direction and passes into the eye 20 and the innermost parts of the flow passages 19. When the impeller 14 is rotating relative to the housing 22, as will be described below, the water is accelerated by centrifugal force. The direction of the water flow becomes radial as the water is thrown outwardly through the flow passages 19 between the blades 18. The water then passes into the outlet region 30 and out through one or more pump outlets 32.

The motor 28 is preferably contained within a waterproof motor casing 34 and disposed below the impeller 14 and housing 22. The motor 28 includes a motor drive shaft (not shown), extending upwardly through the impeller housing 22 into the impeller 14 to rotate the impeller 14. The motor may be an AC or DC motor. A power source 36 may provide power to the motor. A typical DC motor may have a self-contained power source, such as a battery pack, which may be attached to the motor casing 34 to supply electrical power to the motor 28, as shown. In other embodiments, a remote power source, such as a battery of a boat, may be connected through electrical wires to the motor. A timer or a simple timing circuit (not shown) may be used in conjunction with the battery pack to control a switch (not shown) that selectively completes or breaks the connection between the battery pack and the motor. In other embodiments, the motor may be other than an electrical motor, such as a hydraulic motor.

The motor casing 34 includes an upper wall 35 that surrounds the impeller housing 22, except for the pump outlet 26. The upper wall 35 extends above the impeller housing 22 and abuts the underside of the float 42. A cavity 40 is defined between the upper wall 35, the impeller housing 22, and the underside of the float 42. The upper wall 35 includes an annular top portion, having strainer holes 38 integrally formed therein. The strainer holes 38 allow the entry of water into the cavity 40, but prevents the passage of debris that could clog or plug the pump and cause pump failure. The strainer holes may further have screen(s) connected to the holes to further restrict the passage of unwanted materials. The strainer holes 38 may be directionally oriented or vaned to assist in directing the inlet of fluid. In some embodiments, the direction may offset or counter the natural rotation of the aerator caused by the inertia of the rotating impeller, as described more fully in the '762 patent, referenced above. An annular restraining wall 54 extends downwardly from the underside of the float 42 toward the top wall 24 of the impeller housing 22 to form a water control annulus 56. Naturally, other openings and methods could be used to restrict the flow of water or even other fluids to the impeller, and thus, the term "annulus" would include any such openings, regardless of whether it was circular or had other shapes, was continuous about the periphery or had segmented openings, or other variations. Similarly, the term "circumferentially" is not restricted to a circularly shaped object, but includes any variety of shapes such as rectangular, elliptical, or other polygonal shapes. The water control annulus 56 may limit the amount of the water flowing into the pump inlet 26 to an amount below the pump handling capacity, so that the pump 12 draws fluids (either air or water depending on the mode of operation as discussed below) from the float 42 for the remainder of the pump capacity. Preferably, the water control annulus 56 limits the amount of the water flowing into the pump inlet 26 near a point on a pump curve where cavitation may occur. The slots or holes in the strainer 38 are more than adequate, in size and number, to provide enough cumulative flow area for liquid to satisfy the pump. However, water control annulus 56 does not. Rather, and in contravention to conventional centrifugal pump practice, water control annulus 56 is specifically designed to limit the flow of fluid to the pump, so that, if the pump is operating in its normal range of speeds, and at the depth range at which float 42 will support the pump in the water, the water control annulus 56 will not pass as much liquid per unit time as the pump can handle. Thus, the pump will take in air through the passage 44 of float 42. Water control annulus 56 is preferably made small enough, so that the pump will continually vacillate between a primed condition and a non-primed condition.

These conditions cause a high degree of turbulence in the water flowing over wall 24 into inlet 26. Furthermore, due to the relatively small size of water control annulus 56, the internal water level within passage 44 will be very low, much lower than the exterior water level 21, so that the turbulent water passing over wall 24 will be in a relatively thin layer. Under ideal conditions, this layer of turbulent water corresponds in thickness to the height of water control annulus 56. If the water control annulus 56 were large enough to allow the pump to be satisfied fully by water flow, the water level would rise higher in passage 44. All of these factors cooperate to maximize the amount of air that is thereby entrained in the water as it enters and passes through the pump.

The float 42 provides buoyancy to the aerator to adequately support the entire aerator 10 in a floating position. At the floating position, as shown in FIG. 1, the top surface of the aquatic environment is at about a middle section of the float 42, and the pump 12 is submerged below the top surface of the aquatic environment. The float 42 attached to the housing may be formed of synthetic foam or other suitable buoyant material, and is adapted to adequately support the entire pump 10 in a floating position with the float 42 bridging the exterior water level 21, as shown. The float 42 forms an upstanding housing extension conduit with its central inlet passage 44 aligned with inlet 26. The inlet passage 44 is preferably wide as compared to inlet 26, that is, about the same width as inlet 26 or even wider. This size not only allows a large supply of air to the impeller 14, but also eliminates small and tight places near the top of the impeller, wherein any shrimp feelers or the like that might manage to bypass the strainer or splash over the top of the float 64 might otherwise lodge.

Adjustment of the pump 10 to obtain the desired performance may be done empirically. For example, the vertical spacing of the float 42 from the wall 24 can be varied using annular shims of various sizes, looking down through the center passage 44 while the impeller is rotating, and observing the low internal liquid level and turbulent action desired. Then, for a production model, the shims can be replaced by a suitably sized integral float.

In some embodiments, the aerator may not include a float 42 and at least some portion could be mounted below the water level at some elevation. In such instances, the inlet passage 44 could include a sufficiently long conduit 43, so that the conduit extends at least above the water level 21 and preferably to a temperature adjusting unit 89.

To obtain non-ambient temperature air, a temperature adjusting unit 89 may be used. In one embodiment, the temperature adjusting unit 89 may be an automobile air conditioner. In this embodiment, the typical automobile air compressor, piping, and drive belts (not shown) provide cooling to the automobile by passing ambient air 94 over a cooling coil 92 to adjust the air temperature to a non-ambient temperature, typically approximately 30° F. cooler than the ambient temperature. The temperature adjusted air 96 then flows into the automobile. For the present invention, a conduit 43 may be fluidicly connected to an exhaust of the temperature adjusted air 96, so that as the aerator draws air into the inlet passage 44, it draws temperature adjusted air. Naturally, the conduit could be physically connected to the exhaust or positioned in proximity to the exhaust, so that either way, fluidicly the conduit could conduct the temperature adjusted air to the pump. The temperature adjusted air then is entrained or mixed into the liquid and exhausted through the outlet of the aerator, which air then acts to lower the temperature of the liquid in the container. This embodiment is especially useful when transporting bait in an automobile from the place of purchase to the place of fishing. Although not shown, a refrigeration unit operating under similar principles, may be used in place of the automobile air conditioner. A refrigeration unit might be stationary, for instance, in a more permanent installation of a bait house or a pond. The refrigeration unit may be portable, as well, such as one powered by a gasoline generator or a propane unit.

Alternatively, if the temperature needed to be heated instead of cooled, the automobile heating coil 91 could be used. The air flow system in an automobile typically would disengage the air compressor and flow hot water through a heating coil 91 to heat the ambient air 94 to a heated condition to produce the temperature adjusted air 96. Similar principles as the cooled air discussed above could apply using the inlet passage 44 into the aerator 10 for exhausting non-ambient temperature air through the outlet of the aerator. Naturally, other heating units could be used, including gas or coal fired heaters, as well as electrical resistance heaters.

Figure 4:
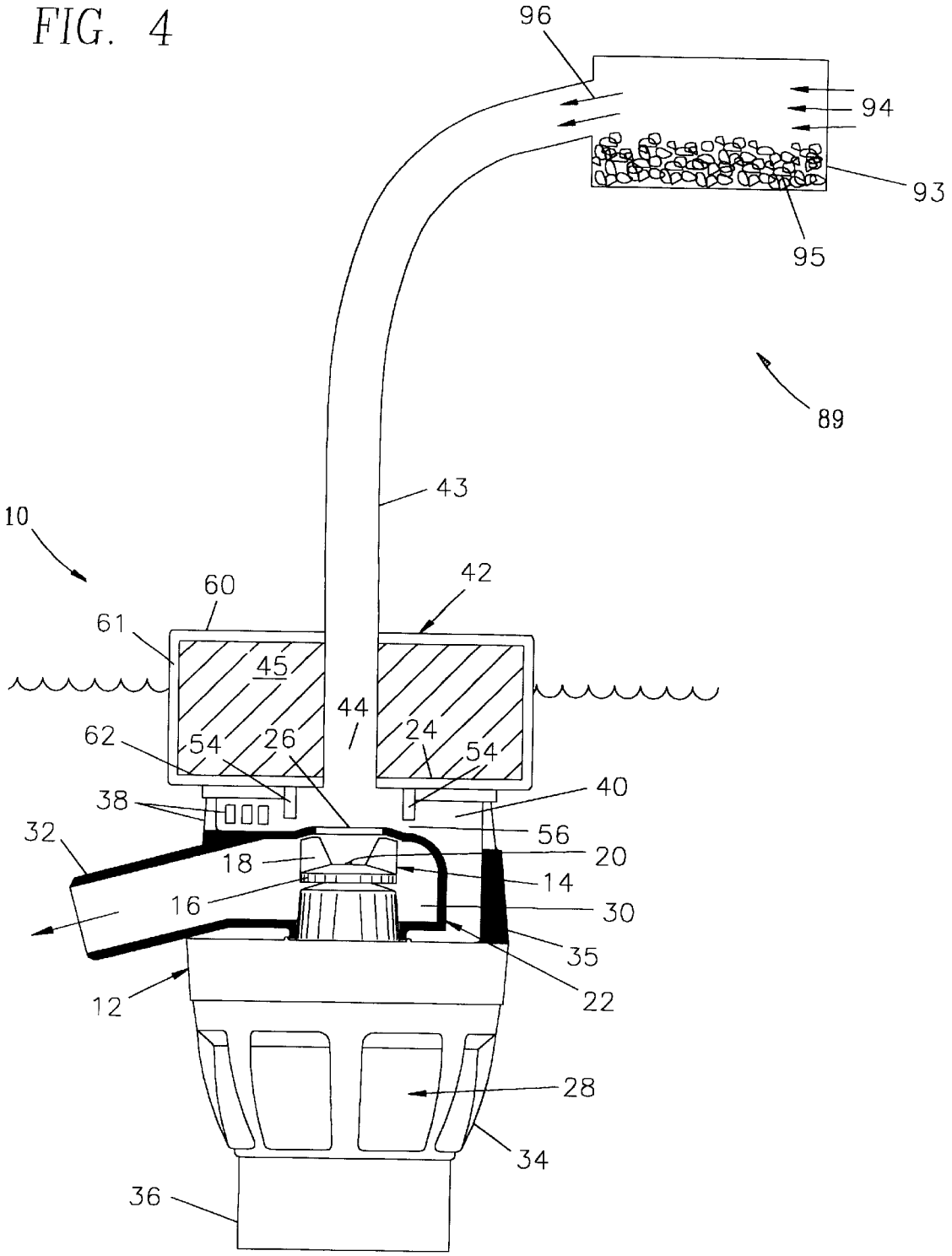
FIG. 4 is a cross-sectional view of the pump of FIG. 1 with an alternative embodiment source for non-ambient temperature gas, using a cooled chamber.

Another embodiment of the temperature adjusting unit 89 is shown in FIG. 4, using a gas drawn through a chilled environment of cooled liquid or gas. The ambient air 94 enters the chamber 93 and passes over the cooled liquid 95, which lowers the temperature adjusted air 96 to a non-ambient temperature. By "cooled", the temperature is relative to the ambient temperature and can include frozen liquids such as ice, frozen $CO_2$, commonly known as "dry ice", and so forth. This embodiment may be especially useful when the aerator is remote from the automobile of the prior embodiment, such as in a boat. An ice chest could be prepared to draw air over the ice and into the aerator. A simplified embodiment could be to insert the conduit 43 into the ice chest through the lid and let it lay adjacent to the ice, so that as air was drawn into the inlet passage 44, it would be drawn across the ice. Other variations of this underlying inventive concept would be recognized by others with ordinary skill in the art.

Figure 5:
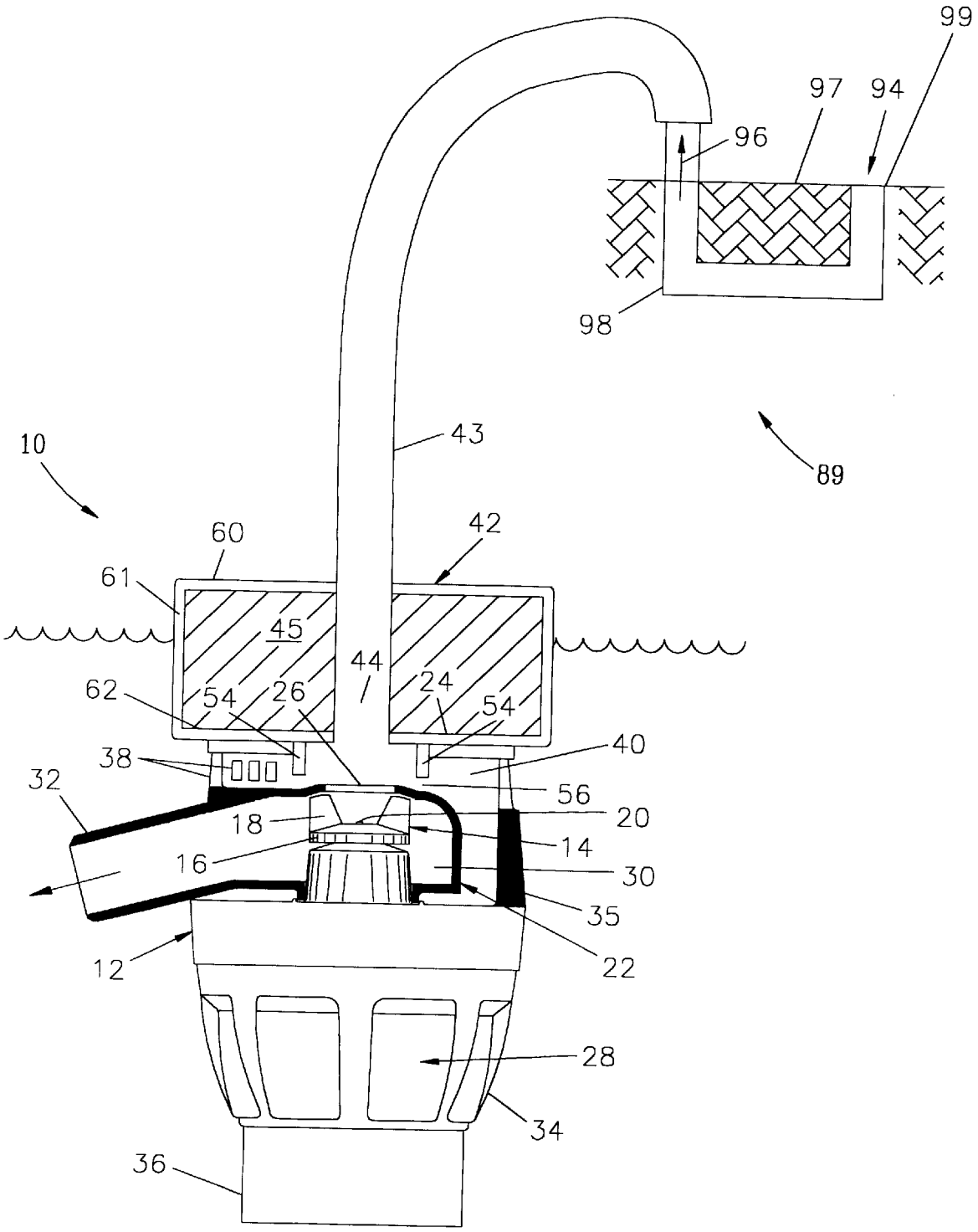
FIG. 5 is a cross-sectional view of the pump of FIG. 1 with an alternative embodiment source for non-ambient temperature gas, using an underground thermally stabilized conduit.
Figure 6:
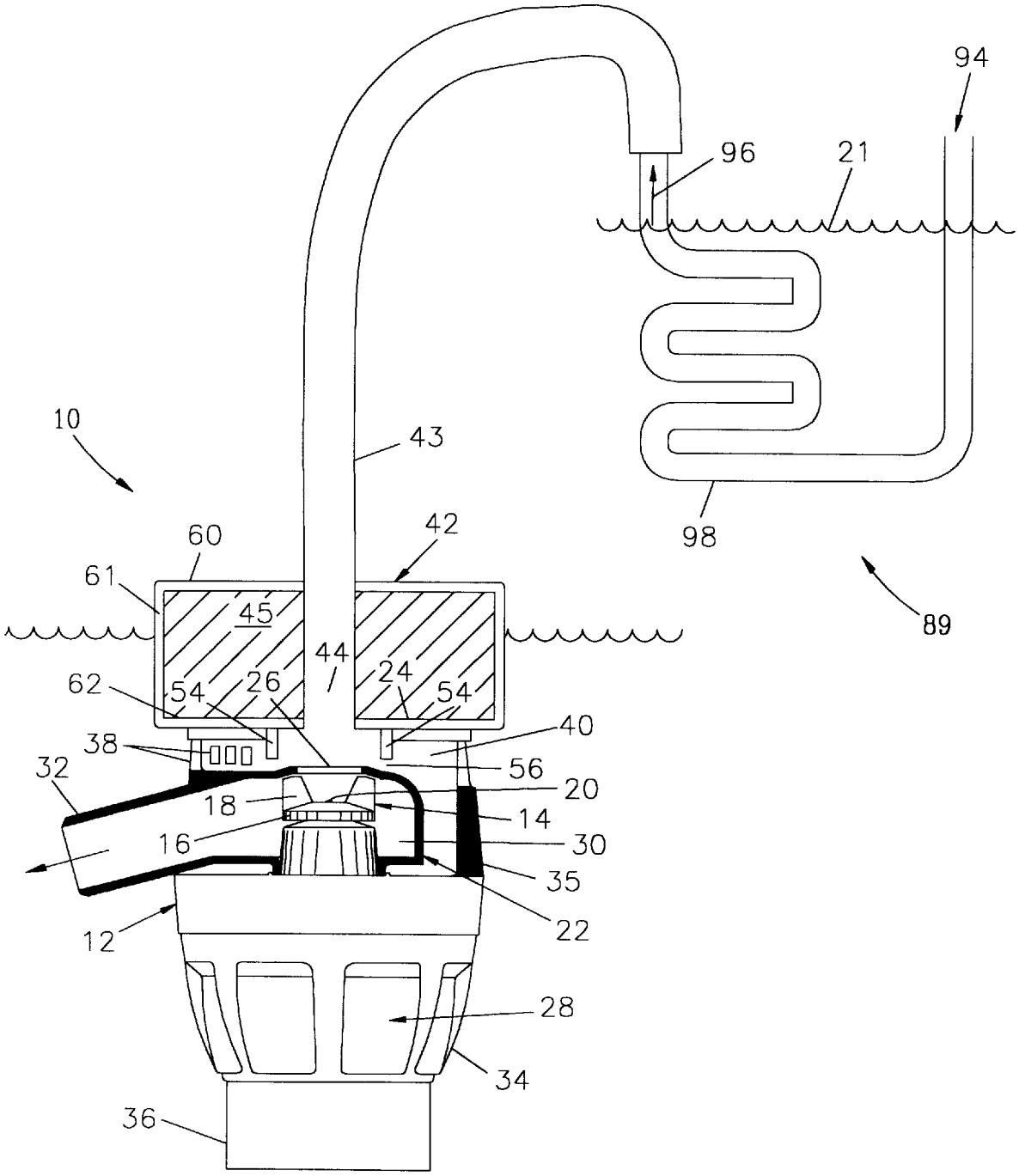
FIG. 6 is a cross-sectional view of the pump of FIG. 1 with an alternative embodiment source for non-ambient temperature gas, using an underwater thermally stabilized conduit.

Another embodiment of the temperature adjusting unit 89 is shown in FIGS. 5 and 6, using a thermally stabilized conduit 98, having a portion below ground level 97. It is well known that subsurface temperatures stabilize, more or less independently of surface temperatures on land or water. For instance, normal underground temperatures range between 55° and 60° F., more or less independently of winter or summer conditions. Such stabilized temperatures have been used in home air conditioning systems, by pumping liquids to a subsurface level to be cooled or heated, depending on the season, to reach a stabilized temperature and then recycled up to the home. For the present invention, air could be drawn through a subsurface thermally stabilized conduit 98, where the ambient air 94 enters the entrance 99 and exits as temperature adjusted air 96 into the conduit 43, as the aerator draws the air. This embodiment could be useful for a more permanent installation, such as a bait house or a pond. Naturally, variations are possible, such as providing a pump (not shown) to force air into the thermally stabilized conduit 98 to overcome any frictional losses and even provide positive pressure to the conduit 43, or the pump could be placed at the exit of the thermally stabilized conduit to pull air through the conduit 98. FIG. 6 shows an alternative of FIG. 5, using the thermally stabilized conduit 98 subsurface to the water level 21, where the depth of the lower section of the conduit 98 could be determined by the water temperature desired.

Figure 7:
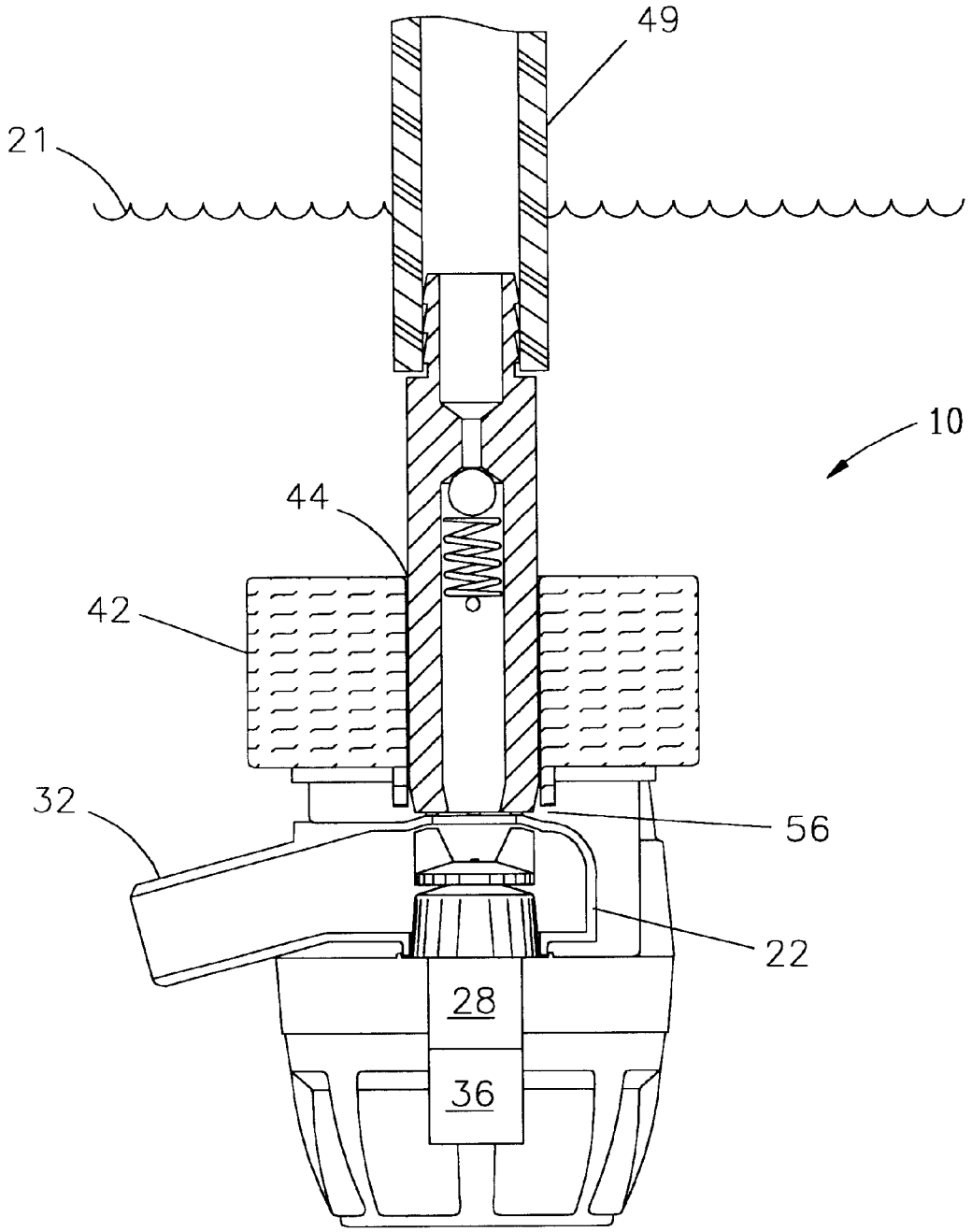
FIG. 7 is a cross-sectional view of the pump of FIG. 1, shown in a pumping mode.

FIG. 7 is a cross-sectional view of the pump 10 of FIG. 1 in a water pumping mode. The pump 10 operates similarly in pumping mode as in the aerating mode, except that the passage 44 through the float 42 is flooded with water from below the water level 21. In order to flood the passage 44, it is merely necessary to submerse the pump. Alternatively, the passage 44 may be coupled to another water source by inserting a tube 49 into the passage 44. In either case, the pump impeller 14 receives only water, i.e., through the water control annulus 56 and the passage 44, either through the float 42 or the tube 49. Without the introduction of air, the pump 10 is switched from an aerating mode to a pumping mode in which the impeller housing 22 is liquid full.

Figure 8:
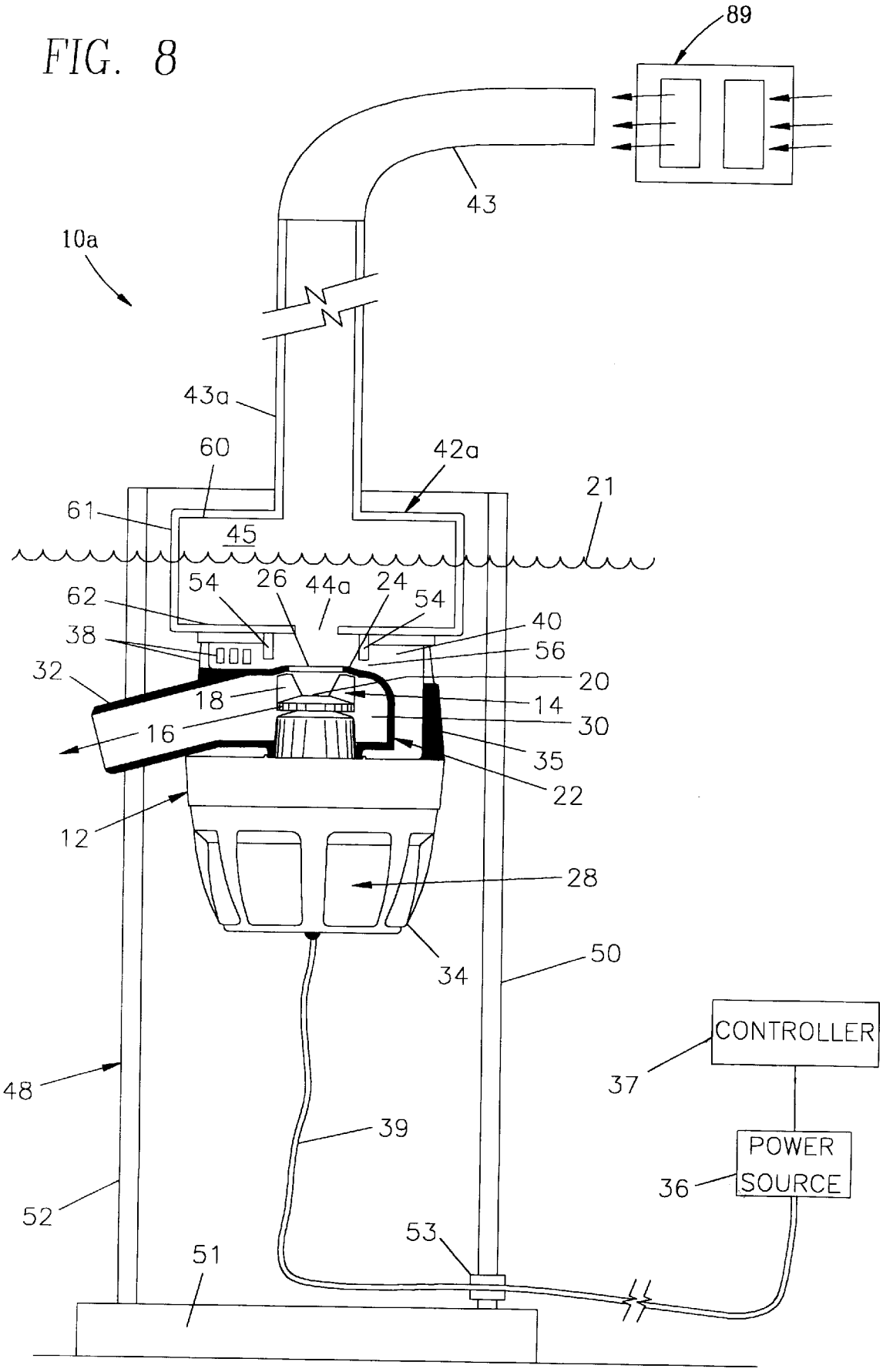
FIG. 8 is a cross sectional view of an alternative to the aerator of FIG. 1, showing a variable buoyancy aerator, according to the invention.

FIG. 8 shows an alternative embodiment of the aerator 10 of FIG. 1 where the aerator is a variable buoyancy aerator 10*a*, having elements similarly numbered. A primary difference is an evacuable float 42*a* replaces the fixed buoyancy float of FIG. 1 and allows the aerator to move vertically in the water depending on the pumping rate and air flow into and out of the evacuable float. The float 42*a* comprises an evacuable compartment 45, having an upwardly extending air inlet tube 43*a* and a bottom orifice 44*a* aligned above the pump inlet 26. The compartment 45, defined by a top 60, a bottom 62 and a side wall 61 extending between the top 60 and the bottom 62, is sized by the internal volume proportionately to the weight of the aerator 10*a* to provide sufficient buoyancy to float the aerator when the compartment 45 is filled with air. As shown in FIG. 8, the air inlet tube 43*a* extends from the top 60 of the compartment 45 and provides an air passage into the compartment 45. The air inlet tube 43*a* is preferably longer than the depth of the aquatic environment so that when the variable buoyancy aerator is resting at the bottom of the aquatic environment, one end of the air inlet tube 43*a* extends above the surface of the aquatic environment. The bottom of the compartment 45 includes a bottom orifice 44*a* positioned above the pump inlet 26 to provide an air passage to the pump inlet 26. The bottom orifice 44*a* is preferably smaller in diameter as compared to the diameter of the pump inlet 26 to restrict fluid flow from the compartment 45 when the float is completely or partially filled with water. However, the bottom orifice 44*a* is sized to provide a sufficient supply of air to the impeller 14 when the float is filled with air. The size of the bottom orifice 44*a* is a factor in determining the flow rate of fluids from the compartment 45 and the time required to empty a compartment 45 that is filled with water. The opening size of the orifice may be varied or adjusted in some embodiments. For instance, a hole with an adjustable needle could be used. Also, a variety of interchangeable orifices with different sizes could be used to alter the opening. Thus, the size of the bottom orifice 44*a* is a factor in determining the time required for the aerator 10*a* to switch between a pumping mode and an aerating mode, discussed below.

Similar to the aerator 10 of FIGS. 1–6, the temperature adjusting unit 89 may be used to provide non-ambient temperature air. The aerating system of FIGS. 8–13 shows the temperature adjusting unit embodiment of FIG. 1, but any of the temperature adjusting unit embodiments herein described could be used singularly or in combination, as well as others, in keeping with the scope of the claims.

The float 42*a*, when filled with air, provides buoyancy to the variable buoyancy aerator to adequately support the entire variable buoyancy aerator 10*a* in a floating position. At the floating position, as shown in FIG. 8, the top surface of the aquatic environment is at about a middle section of the float 42*a*, and the pump 12 is submerged below the water level 21 of the aquatic environment.

The variable buoyancy aerator 10*a* is preferably disposed within an aerator guide 48 that confines the lateral movement of the aerator 10*a* within the aquatic environment, while allowing vertical travel of the aerator. As shown in FIG. 8, the aerator guide 48 comprises a guide sleeve 50 having an inner diameter slightly larger than the largest outer diameter of the variable buoyancy aerator 10*a* and a weight support 51, such as a concrete block, to secure the guide sleeve 50 on the bottom of the aquatic environment. The guide sleeve 50 includes a slot 52 running from a bottom portion to a top portion of the guide sleeve 50 through which the pump outlet 26 protrudes. The guide sleeve 50 guides the vertical movement of the variable buoyancy aerator 10*a*, and the slot 52 determines the radial direction of the pump outlet 26. The slot 52 can be a vertical slot that confines the pump outlet 26 in one direction, a spiral slot that rotates the direction of the pump outlet 26, or other shapes that provide a path for the movement of the pump outlet 26, as the variable buoyancy aerator 10*a* travels vertically within the guide sleeve 50. The electrical wire 39 attached to the motor 28 is preferably introduced through a hole 53 disposed at the bottom of the guide sleeve 50 to minimize the possibility of entanglement with the variable buoyancy aerator 10*a* as the aerator moves vertically. Other devices, such as a pole and ring device wherein one or more rings attached to the aerator are looped over a vertically extending pole fixedly positioned in the aquatic environment, could be used to confine the lateral movement of the aerator within the aquatic environment, while guiding the vertical movement of the aerator. A power source 36 is electrically connected to the pump 12 through electrical wires 39, and a controller 37 is connected to the power source 36 to regulate operation of the aerator 10*a*. The power source may be a remote battery, or in a more stationary application, a 110 volt AC source, or other power sources. In some embodiments, the motor may be a variably controlled motor, such that varying outputs may be maintained. Thus, it may be possible to control even the elevation at predetermined intermediate elevations by considering the output in relation to the available inflow of fluid and air to the pump. In this sense, the controller may offer more regulation options than an on/off controller and may be variably adjusted. The controller 37 may include a microprocessor that is programmable to switch between periods of activation (electrical power being supplied to the motor) and deactivation (electrical power not supplied to the motor) of the variable buoyancy aerator 10*a*. When a plurality of aerators 10*a* are being controlled in a system for maintaining an aquatic environment, the controller 37 may be programmed to activate/deactivate the aerators in particular timing schemes, such as synchronously and sequentially. Alternatively, the controller 37 comprises a simple timing circuit or a timer that switches between on/off states of the electrical power delivered to the motor 28.

The pump 12 is adapted for continuous operation between an aerating mode and a pumping mode. In the aerating mode, the pump 12 takes in a controlled amount of water from the aquatic environment and air through the air inlet tube 43*a* extending above the float 42*a*. The mixture of air and water is pumped out through the pump outlet 32 to provide aeration to the aquatic environment. In the pumping mode, the float 42*a* is flooded with water, so that the supply of air to the pump 12 is substantially cut off, causing the pump 12 to draw in only water and discharge the water under pressure through the pump outlet 32. The conduit 43 may be flexible to facilitate movement of the variable buoyancy aerator 10*a*.

While in the above described embodiment, the outlet is positioned above the motor, such an arrangement is not crucial to accomplish the goals of the present invention. In some embodiments, the outlet could be below the pump. For instance, an annulus or conduit directing the fluid from the pump inlet through the impeller to an opening located below the motor may be used, which fluid flow may offer cooling benefits to the motor, if cooling is desired.

Figure 9:
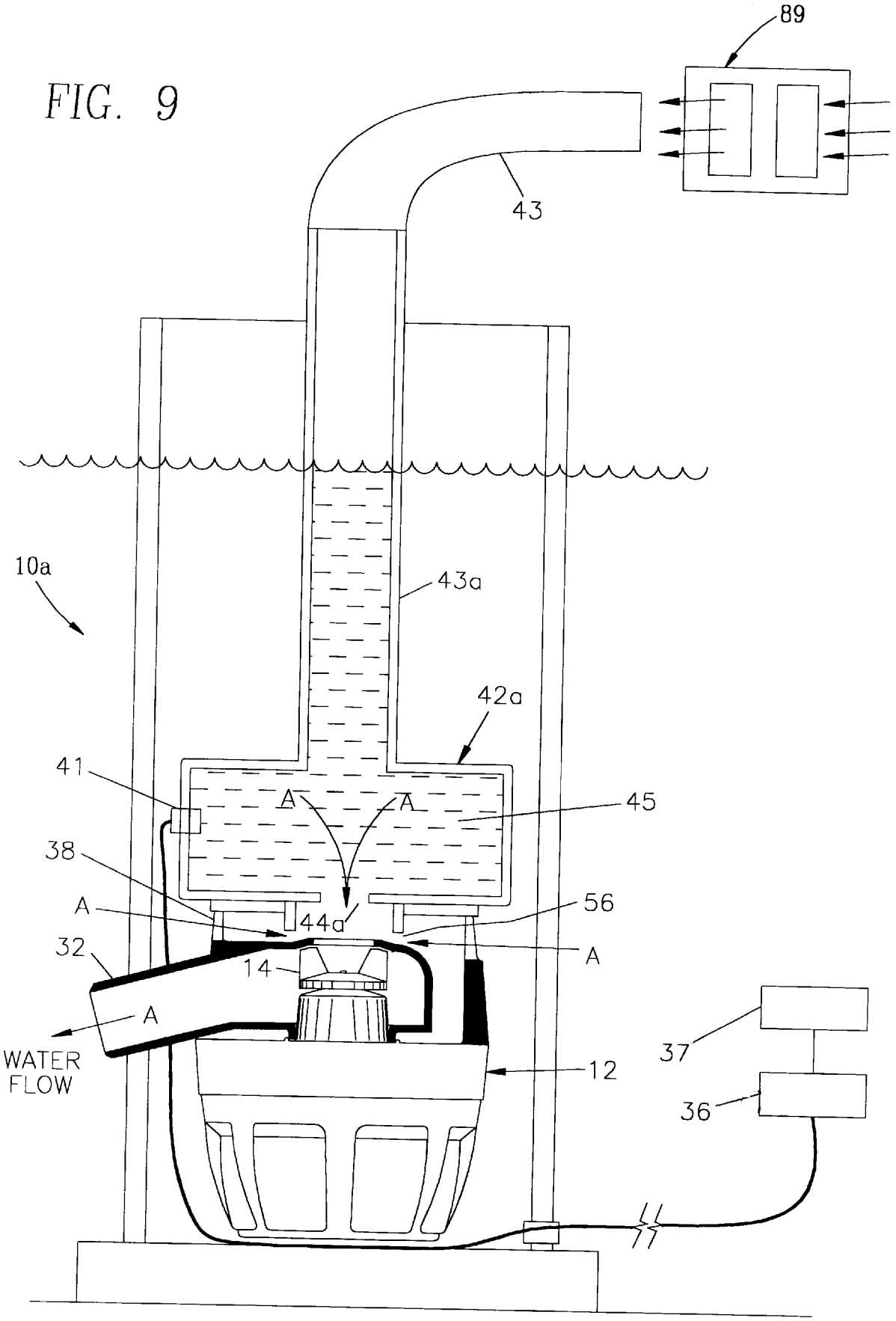
FIG. 9 is a cross sectional view of the variable buoyancy aerator in a full water pumping mode.

FIGS. 9–13 illustrate the operation cycle of a variable buoyancy aerator, according to the present invention. FIG. 9 is a cross sectional view of a variable buoyancy aerator in a pumping mode. As shown, the variable buoyancy aerator 10*a* is resting at its lowest position, near the bottom of the aquatic environment. The float 42*a* and the pump 12 are filled with water, and the portion of the air inlet tube 43*a* below the surface of the aquatic environment is also filled with water. To begin the water pumping mode, the controller 37 activates the variable buoyancy aerator 10*a* by supplying electrical power from the power source 36 to the pump 12. As the impeller 14 rotates, water is drawn from both the water control annulus 56 and the bottom orifice 44*a* of the float 42*a* and pumped out through the pump outlet 32. The direction of the water flow is indicated by arrows A. The pump outlet 32 is preferably pointing at a downward angle that promotes agitation of the bottom of the aquatic environment. When the pump reaches full capacity pumping speed, water is pumped out of the variable buoyancy aerator 10*a* with such force that agitation of the bottom of the aquatic environment occurs. As more water is pumped through the outlet 32 than can be drawn through strainer holes 38 and annulus 56, water is drawn from the compartment 45 of the float 42*a*. Air is then drawn through the air inlet tube 43*a* and begins to fill the compartment 45 of the float 42*a*. Filling the float 42*a* with air creates a buoyant force that lifts the variable buoyancy aerator 10*a* from the bottom resting position and moves the variable buoyancy aerator 10*a* upwardly toward the surface of the aquatic environment. Typically, after a substantial portion, i.e., about one-half, of the compartment 45 is filled with air, the pump 12 begins to draw in air as well as water and starts an initial aerating mode.

Also, shown in FIG. 9 is a control valve 41. In some embodiments, it may be desired to rapidly, or at least independently of the annulus/orifice/compartment size/pumping capacity factors, control the elevation of the aerator. The control valve may be an open/close valve, such as a solenoid valve or some variably positioned valve, that can be opened to an intermediate position. It can be controlled remotely by some circuit. Alternatively, it may be a mechanically or chemically opening valve or some other means that could, for instance, be actuated with pressure or other conditions. By opening the control valve, an independent method of allowing fluid into the chamber 45 may be had.

Figure 10:
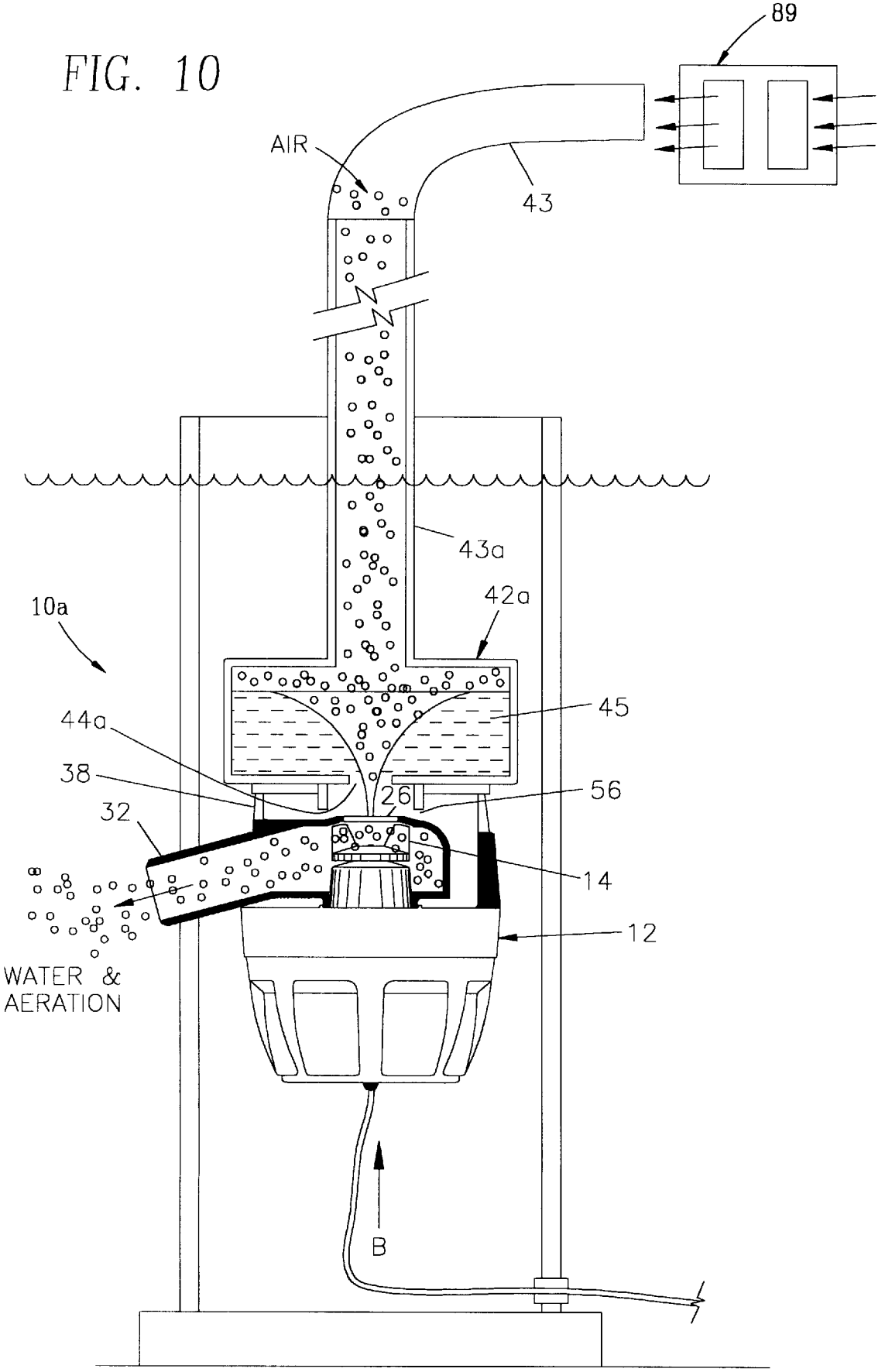
FIG. 10 is a cross sectional view of the variable buoyancy aerator in an initial aerating mode.

FIG. 10 is a cross sectional view of the variable buoyancy aerator in an initial aerating mode. The impeller 14 creates a vortex of the water above the pump inlet 26 in a central region of the compartment 45 of the float 42*a* and draws air along with the residual water in the float 42*a* into the pump 12. The impeller 14 forces the air along with the water through the pump outlet 32 to provide aeration into the aquatic environment. As more water is drawn out of the float 42*a*, more air enters the compartment 45 of the float 42*a* and is drawn into the pump inlet 26 by the impeller 14. The variable buoyancy aerator 10*a* continues to move upwardly, as indicated by arrow B, with additional filling of air in the compartment 45. As the float 42*a* becomes completely filled with air, the variable buoyancy aerator 10*a* acquires its maximum buoyancy, floats near the surface of the aquatic environment, and begins to operate in an aerating mode.

The time required to completely draw out the water in the compartment 45 corresponds to a dwell time required for the aerator 10*a* to switch from a pumping mode to an aerating mode. The size of the compartment 45, the size of the bottom orifice 44, the size of the water control annulus 56, and the pumping capacity are factors that determine the dwell time. Thus, by controlling the various ratios of the above factors, the dwell time may be adjusted. Similarly, by controlling the various ratios, the operating depth of the aerator in the water may also be controlled. Faster air intake might correspond to a higher level in the water and so forth.

The inventor has discovered that use of the annulus may also have an effect on the amperage required to operate the motor. For instance, the present invention appears to have less amperage requirements with the entrained air. Thus, amperage control is also possible with this invention.

Figure 11:
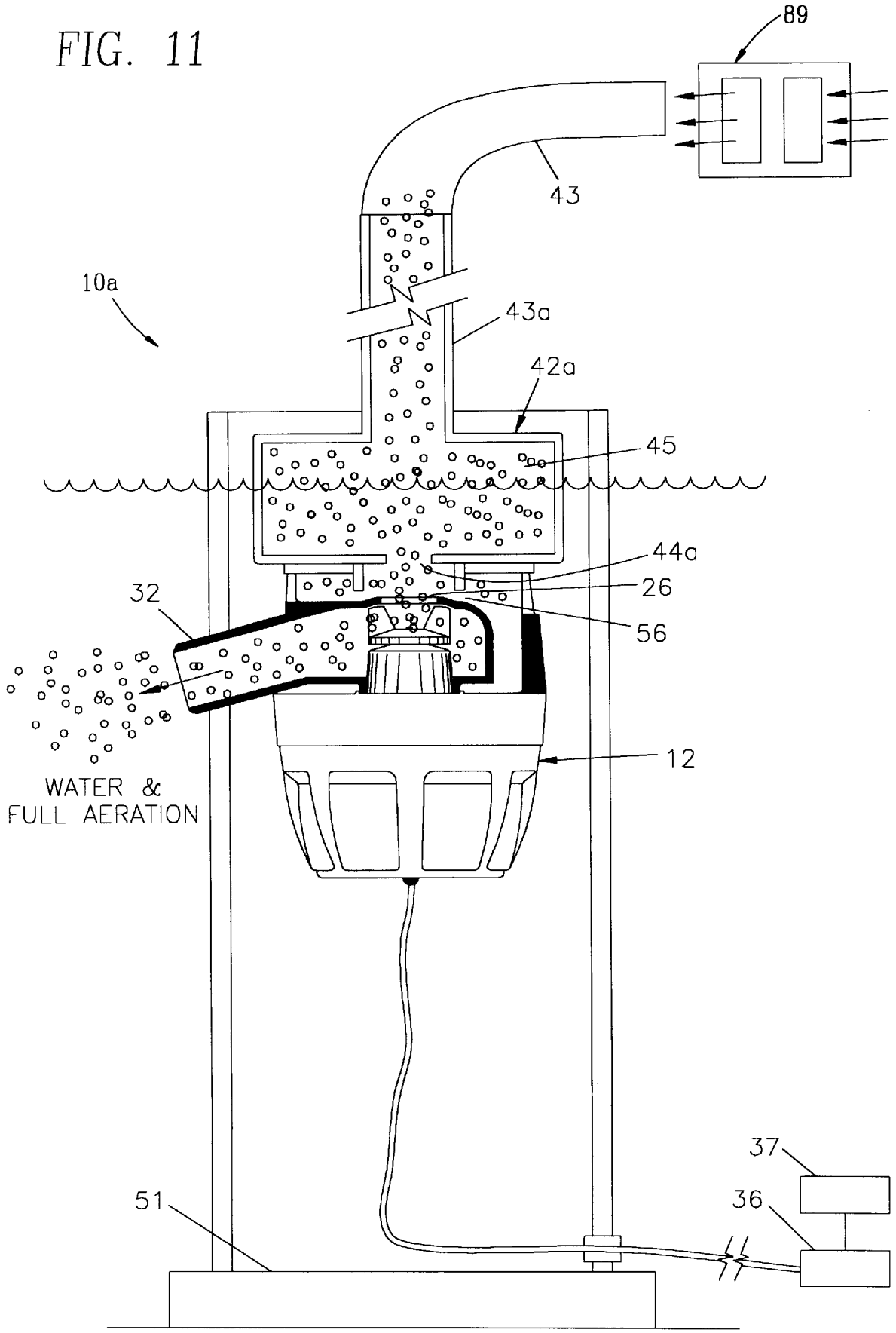
FIG. 11 is a cross sectional view of the variable buoyancy aerator in a full aerating mode.

FIG. 11 is a cross sectional view of the variable buoyancy aerator in a full aerating mode. The variable buoyancy aerator 10*a* provides the maximum aeration in the aerating mode, because water only enters into the pump inlet 26 through the water control annulus 56. With the float 42*a* filled completely with air, the variable buoyancy aerator 10*a* acquires its maximum buoyancy and its highest vertical position within the aquatic environment. The variable buoyancy aerator 10*a* is kept activated in the aerating mode for a period of time necessary to achieve the desired oxygenation level of the aquatic environment. After the desired oxygenation level has been achieved, the controller 37 shuts off the electrical power supplied to the pump 12, and the variable buoyancy aerator 10*a* is deactivated.

Figure 12:
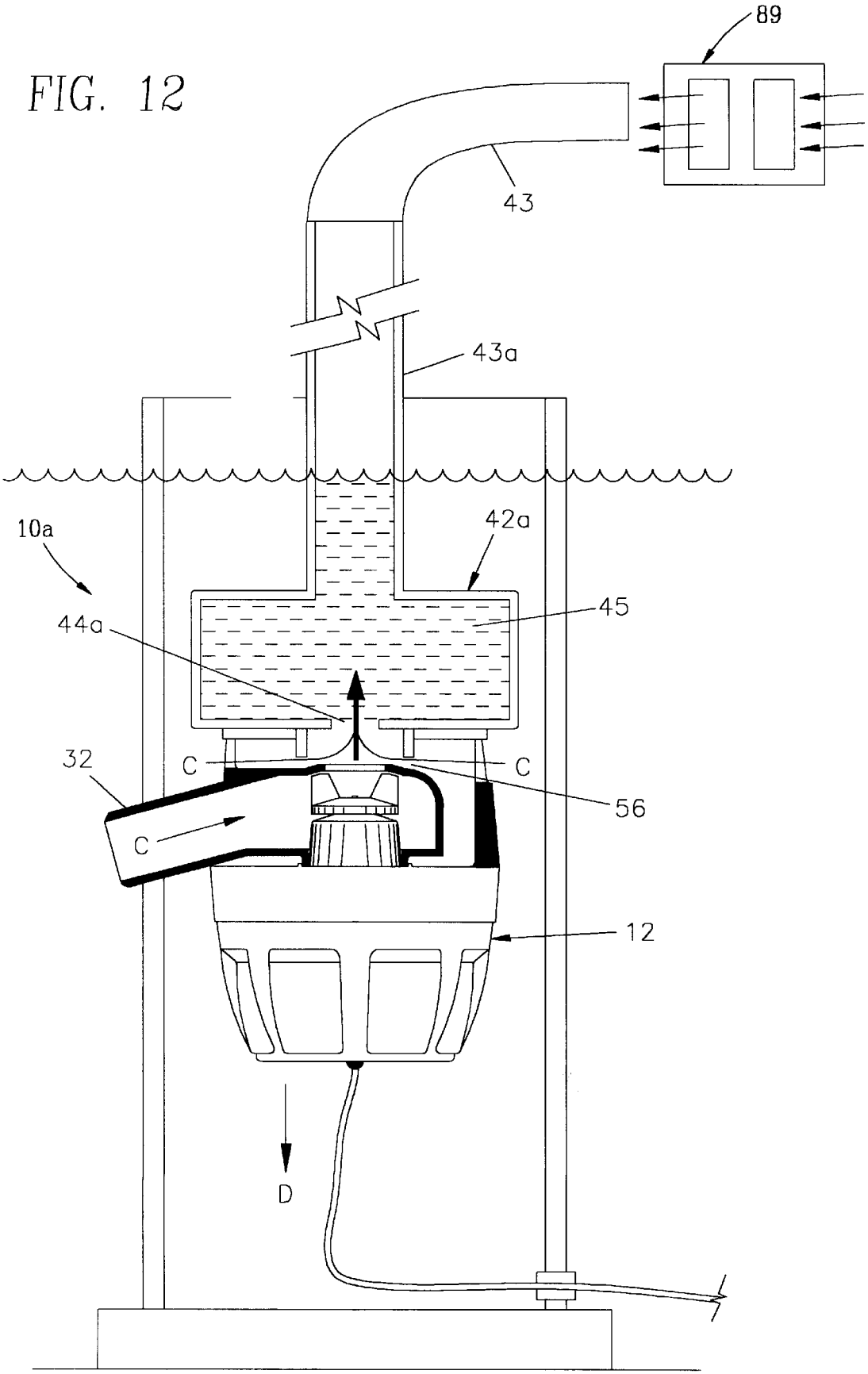
FIG. 12 is a cross sectional view of the variable buoyancy aerator after deactivation.

FIG. 12 is a cross sectional view of the variable buoyancy aerator after deactivation.

Because the pump 12 is shut off, air is no longer drawn into the pump 12, and water begins to fill compartment 45 of the float 42*a* through the water control annulus 56, and then through the bottom orifice 44*a*. The flow of the water is indicated by arrows C. As the float 42*a* becomes filled with water, the variable buoyancy aerator 10*a* loses its buoyancy and begins to sink, as indicated by arrow D. The variable buoyancy aerator 10*a* continues to sink until it reaches some predetermined level, such as weight support 51 or the bottom of the aquatic environment.

Figure 13:
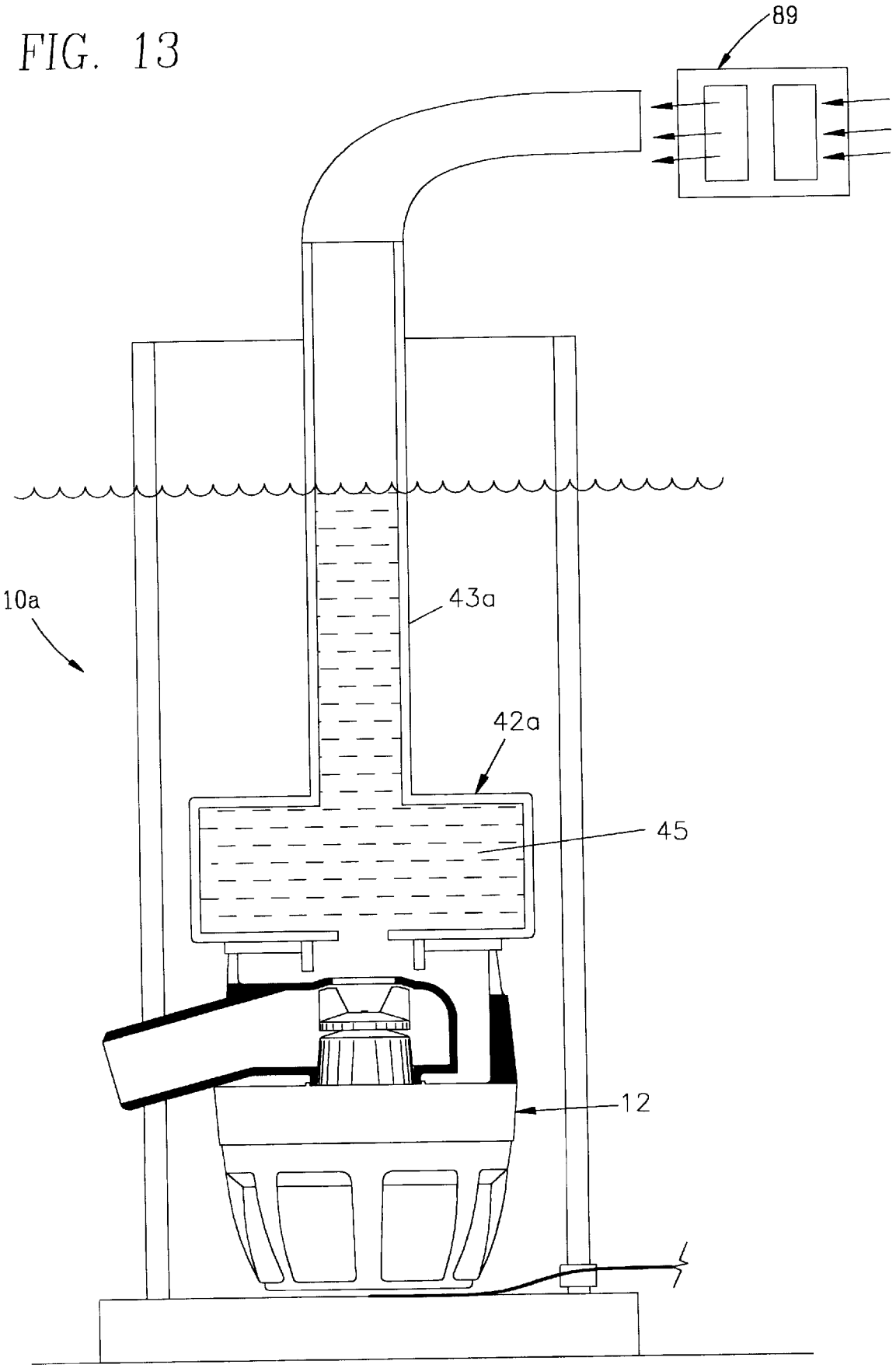
FIG. 13 is a cross sectional view of the variable buoyancy aerator in a deactivated stage.

FIG. 13 is a cross sectional view of the variable buoyancy aerator in the deactivated stage. As shown, the pump 12, the compartment 45 of the float 42*a*, and the portion of the air inlet tube 43*a* below the surface of the aquatic environment are completely filled with water, and the variable buoyancy aerator 10*a* is resting at the lower limit of its travel, such as near the bottom of the aquatic environment. The variable buoyancy aerator 10*a* is kept deactivated for a period of time until agitation and/or oxygenation of the aquatic environment is needed. When the pump 12 is energized again, the operation cycle of the variable buoyancy aerator 10*a*, as illustrated in FIGS. 9–13, is repeated.

Figure 14:
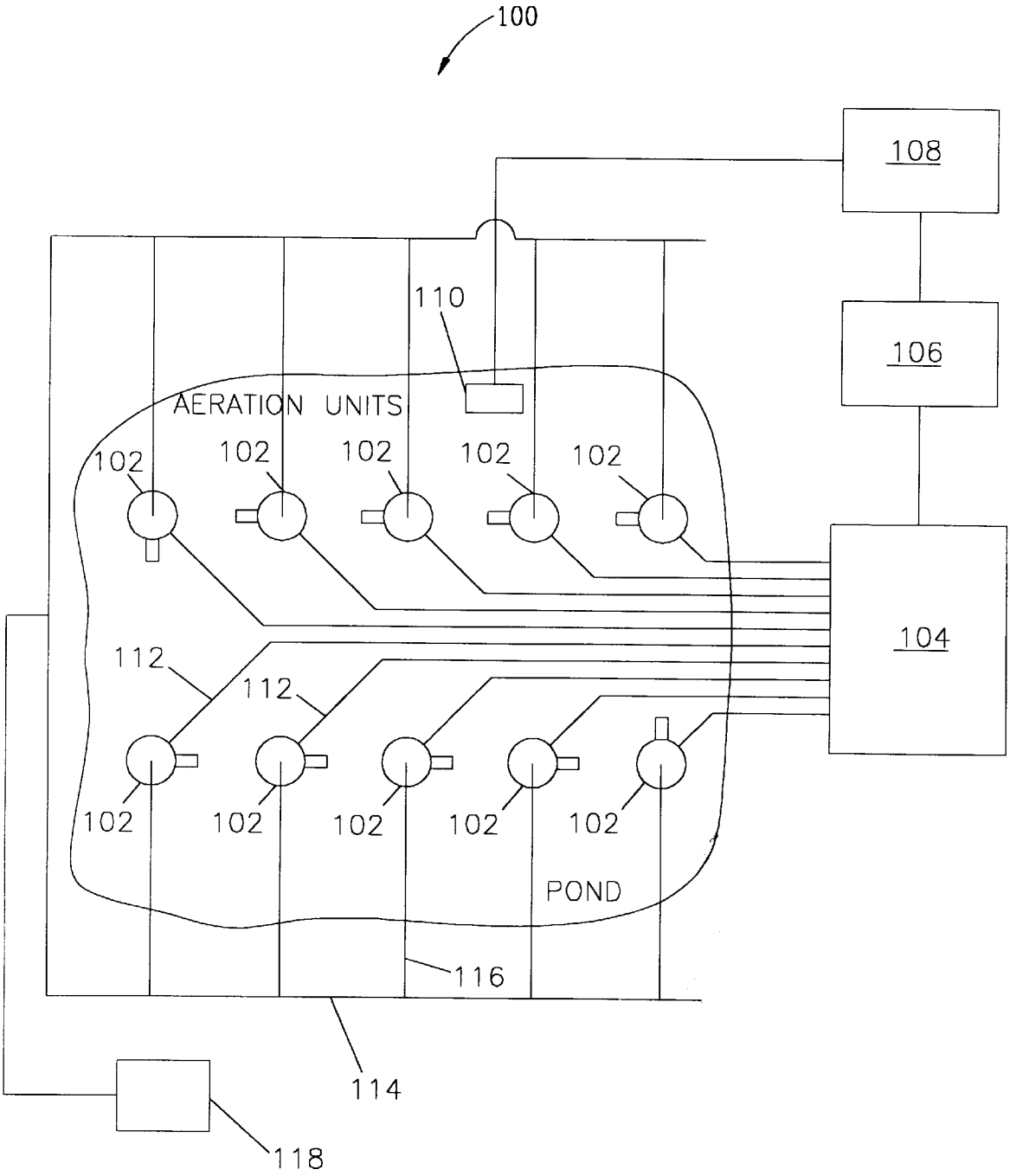
FIG. 14 is a schematic diagram of a system for maintaining an aqua-culture environment, according to the invention.

To provide aeration and bottom agitation to the aquatic environment, one or more variable buoyancy aerators may be used depending on the size of the aquatic environment and the capacity of the variable buoyancy aerator used. FIG. 14 is a schematic diagram of an aeration system for maintaining an aqua-culture environment according to the invention. The aeration system 100 generally comprises a plurality of variable buoyancy aerators 102, a power source 104 electrically connected to supply an electrical power to activate the aerators, and a controller 106 connected to the power source to regulate activation of each aerator. The variable buoyancy aerators 102 may be connected individually through electrical wires 112 to the power source 104. Preferably, the electrical connections are water-proof and corrosion resistant to provide long, maintenance-free life. Electrical pipes, such as PVC pipes, can be used to protect the electrical wires from the aquatic environment, as well as the aquatic animals maintained therein.

The controller 106, preferably a programmable controller or a microprocessor, regulates the activation of each variable buoyancy aerator by switching the electrical power supplied to each variable buoyancy aerator between on/off states or the variable states, described above. As shown in FIG. 14, the controller 106 and the power supply 104 are separate units. Alternatively, the power supply 104 and the controller 106 can be a single unit component. The controller 106 may be programmed to activate the variable buoyancy aerator in a synchronized manner, wherein all variable buoyancy aerators are activated and deactivated simultaneously. Alternatively, the controller 106 may be programmed to activate the variable buoyancy aerators in a sequential manner to create a wave-like effect from individually rising and sinking variable buoyancy aerators. Still further, the controller 106 may be programmed to randomly activate any of the variable buoyancy aerators.

Optionally, a monitoring system 108 is connected with the controller 106 to provide signals to the controller 106 that activates or deactivates the variable buoyancy aerators 102 upon appropriate conditions in the aquatic environment. The monitoring system 108 may comprise one or more sensors 110 disposed in the aquatic environment that senses conditions such as temperature, oxygen level, and water flow, as could be available from various suppliers known to those with ordinary skill in the art. Typically, the monitoring system 108 sends a signal to the controller 106 to regulate activation of the variable buoyancy aerators 102, when the sensed condition needs changing, and a signal to deactivate the variable buoyancy aerators 102, when the aquatic environment is in a desired condition. Preferably, the monitoring system 108 provides signals that trigger the controller 106 to activate or deactivate the variable buoyancy aerators 102 on an individual basis. The monitor system 108 may also include sophisticated microprocessors and/or sensors, such as a satellite monitoring system (not shown).

In addition to providing aeration and agitation, the aeration system 100 provides controlled circulation in the aquaculture environment and eliminates stagnant water flow regions. By positioning the variable buoyancy aerators 102 in a particular arrangement and pointing the pump outlets of each variable buoyancy aerator 102 in a particular direction, the system 100 can achieve specific water flow patterns. For example, by pointing the pump outlets in a sequential manner, i.e., each outlet points to the next aerator, when the variable buoyancy aerators are positioned as shown in FIG. 14, the aeration system 100 provides a substantially oval circulation or agitation pattern. Preferably, the aeration system 100 includes a plurality of aerators disposed throughout the aquatic environment to provide agitation to a substantial portion of the aquatic environment. Alternatively, each aerator 102 can include a plurality of outlets, as shown in FIG. 3, in a number of directions to increase the area agitated by each aerator.

The aeration system 100 may include a temperature adjusting unit 118, similar to the temperature adjusting unit 89, shown in FIGS. 1–6. In this instance, a manifold 114 may be located in proximity to or connected to the outlet of the temperature adjusting unit 118. Lateral conduits 116, similar to conduit 43 of FIGS. 1–6, may branch from the manifold 114 to some or all of the variable buoyancy aerators 102 for providing temperature adjusted air. Naturally, the aerators could be an aerator embodiment of FIG. 1, an aerator embodiment of FIG. 8, an aerator without the float 42, or other type aerators. Naturally, other arrangement for the temperature adjusting unit could be made. For instance, the "unit" could include a number of subunits connected to each aerator or a portion of the aerators that would provide the temperature adjusted air of the present invention individually or in groups.

While the foregoing is directed to preferred embodiments of the present invention, other and further embodiments of the invention may be devised without departing from the basic scope thereof. The scope of the invention is determined by the claims which follow.

I claim:

1. A system for maintaining an aqua-culture environment, comprising:

a) an aerator having an outlet, a gas inlet connected to a pump;

b) a temperature adjusting source adapted to adjust the temperature of incoming ambient gas upstream from the gas inlet of the aerator; and c) a conduit fluidicly connected between the gas inlet of the aerator and the temperature controlled source.

2. The system of claim 1, wherein the temperature adjusting source comprises a cooling member.

3. The system of claim 2, wherein the temperature adjusting source comprises an air conditioning unit.

4. The system of claim 2, wherein the temperature adjusting source comprises a refrigeration unit.

5. The system of claim 2, wherein the temperature adjusting source comprises gas drawn through a chilled environment of cooled liquid.

6. The system of claim 1, wherein the temperature of the gas is higher than ambient air.

7. The system of claim 6, wherein the temperature adjusting source comprises an automobile heater.

8. The system of claim 6, wherein the temperature adjusting source comprises a heating unit.

9. The system of claim 6, wherein the temperature adjusting source comprises an underground thermally stabilized conduit.

10. The system of claim 1, wherein the temperature adjusting source comprises an underwater thermal stabilized conduit.

11. The system of claim 1, wherein the aerator comprises a liquid inlet separate from the gas inlet and the gas inlet comprises an upwardly extending gas inlet tube wherein the aerator is adapted to mix a quantity of liquid and gas before passing through the outlet.

12. The system of claim 11, wherein the aerator comprises a centrifugal pump having a generally vertical axis and a centrifugal impeller adapted to move liquid from the liquid inlet and gas from the gas inlet, mix the liquid and gas to form a mixed fluid, and pump the mixed fluid through the outlet.

13. The system of claim 11, wherein the aerator comprises an evacuable float having a chamber fluidicly connected to the gas inlet of the pump.

14. The system of claim 11, wherein the aerator comprises an adjustably sized control annulus opening fluidicly connected to the liquid inlet to control an amount of liquid entering the liquid inlet.

15. The system of claim 1, wherein the aerator comprises an evacuable float having a chamber fluidicly connected to the gas inlet of the pump.

16. The system of claim 1, further comprising at least one controller connected to the power source and aerator to regulate activation of the aerator.

17. The system of claim 16, further comprising a plurality of aerators and wherein the controller activates the aerators in regulated order to control agitation of an aqua-culture environment wherein at least one of the aerators is activated at a different time than another aerator of the plurality of aerators.

18. A system for maintaining an aqua-culture environment, comprising:

a) an aerator having an outlet, a pump; and b) a gas inlet fluidicly connected to the aerator for receiving a gas having a non-ambient temperature into the aerator wherein the non-ambient temperature gas is temperature adjusted upstream from the pump and motor of the aerator.

19. A method for maintaining an aqua-culture environment, comprising:

a) providing an aerator having a pump for an aqua-culture environment;

b) delivering a non-ambient temperature gas upstream from the aerator; and c) pumping the non-ambient temperature gas through the aerator into the aqua-culture environment.

20. The method of claim 19, wherein delivering the non-ambient temperature gas comprises cooling the gas from an ambient temperature.

21. The method of claim 20, wherein cooling the gas comprises using an air conditioner.

22. The method of claim 19, further comprising heating the gas from an ambient temperature.

23. The method of claim 22, wherein heating the gas comprises using an automotive heater.

24. The method of claim 22, wherein heating the gas comprises using a heating unit.

25. The method of claim 19, wherein pumping the non-ambient temperature gas comprises pumping through an underground thermally stabilized conduit.

26. The method of claim 19, wherein pumping the non-ambient temperature gas comprises pumping through an underwater thermally stabilized conduit.

27. The method of claim 20, wherein cooling the gas comprises using a refrigeration unit.

28. The method of claim 20, wherein cooling the gas comprises drawing the gas through a chilled environment of cooled liquid.

29. The method of claim 19, wherein pumping the non-ambient temperature gas comprises drawing liquid from a liquid inlet into the pump, mixing the gas with the liquid into a fluid, and pumping the fluid into the aqua-culture environment.

30. The method of claim 29, wherein mixing the gas with the liquid comprises at least partially cavitating the aerator to pump the gas.

31. The method of claim 30, further comprising controlling an amount of fluid entering the aerator with an adjustable control annulus.

32. A system for maintaining an aqua-culture environment, comprising:

a) an aerator having an outlet, a liquid inlet, a pump and an upwardly extending gas inlet adapted to allow gas to enter the pump, the aerator adapted to mix the gas and liquid prior to leaving the outlet;

b) an evacuable float having a chamber fluidicly connected to the gas inlet of the pump;

c) a conduit fluidicly connected to the gas inlet and adapted to receive a gas having a non-ambient temperature; and d) a power source adapted to operate the aerator.

33. A system for maintaining an aqua-culture environment, comprising:

a) an aerator having an outlet; a gas inlet connected to a pump;

b) a temperature adjusting source adapted to cool the temperature of incoming ambient gas upstream from the gas inlet of the aerator; and c) a conduit fluidicly connected between the gas inlet of the aerator and the temperature controlled source.

* * * * *

UNITED STATES PATENT AND TRADEMARK OFFICE

CERTIFICATE OF CORRECTION

PATENT NO. : 5,996,977

DATED : December 7, 1999

INVENTOR(S) : Harry L. Burgess

It is certified that error appears in the above-identified patent and that said Letters Patent is hereby corrected as shown below:

In column 4, line 39, insert a " ." after " off" .

Signed and Sealed this

Fifteenth Day of August, 2000

*Attest:*

*Attesting Officer*

Q. TODD DICKINSON

*Director of Patents and Trademarks*